US005146902A

United States Patent [19]

Cook et al.

[11] Patent Number: 5,146,902

[45] Date of Patent: Sep. 15, 1992

[54] POSITIVE PRESSURE CANISTER PURGE SYSTEM INTEGRITY CONFIRMATION

[75] Inventors: John E. Cook; Murray F. Busato, both of Chatham, Canada

[73] Assignee: Siemens Automotive Limited, Chatham, Canada

[21] Appl. No.: 801,322

[22] Filed: Dec. 2, 1991

[51] Int. Cl.[5] ..... F02M 33/02

[52] U.S. Cl. ..... 123/518; 123/519; 123/520; 123/198 D; 73/118.1; 73/40

[58] Field of Search ..... 123/479, 198 D, 516, 123/518, 519, 520, 521; 73/117.3, 118.1, 40 R, 40.1, 40.5, 40.7

[56] References Cited

U.S. PATENT DOCUMENTS

| | | | |
|---|---|---|---|
| 4,715,214 | 12/1987 | Tveter et al. | 73/40 |
| 4,794,790 | 1/1989 | Margarit-Metaxa et al. | 73/118.1 |
| 4,949,695 | 8/1990 | Vranishi et al. | 123/198 D |
| 4,953,514 | 9/1990 | Beicht et al. | 123/520 |
| 4,962,744 | 10/1990 | Vranishi et al. | 123/198 D |
| 5,022,364 | 6/1991 | Phillips | 73/40 |
| 5,042,290 | 8/1991 | Geisinger | 73/40 |
| 5,065,350 | 11/1991 | Fedder | 73/40 |
| 5,078,006 | 1/1992 | Maresca, Jr. et al. | 73/40 |
| 5,081,864 | 1/1992 | Zain | 73/40 |
| 5,085,197 | 2/1972 | Mader et al. | 123/518 |

*Primary Examiner*—E. Rollins Cross
*Assistant Examiner*—Thomas N. Moulis
*Attorney, Agent, or Firm*—George L. Boller; Russel C. Wells

[57] ABSTRACT

The tank/canister volume's integrity against unacceptable leakage is either confirmed or denied by a diagnostic test performed by an on-board diagnostic system which includes an electrically operated air pump and a pressure switch. At the beginning of a test, the engine management computer closes the canister purge solenoid valve and operates the pump to begin pressurization of the tank/canister volume. Failure to build to a predetermined pressure indicates a gross leak. Upon attainment of the predetermined pressure, the pump is shut off by the operation of the pressure switch from one state to another. The pressure switch has hysteresis so that if the pressure falls below the predetermined pressure by a certain amount during the predetermined duration of the test, the pressure switch returns to its one state thereby giving a signal denying the integrity. Integrity is confirmed by the pressure switch remaining in its another state during the test.

20 Claims, 1 Drawing Sheet

POSITIVE PRESSURE CANISTER PURGE SYSTEM INTEGRITY CONFIRMATION

FIELD OF THE INVENTION

This invention relates generally to evaporative emission control systems that are used in automotive vehicles to control the emission of volatile fuel vapors. Specifically the invention relates to an on-board diagnostic system for determining if a leak is present in a portion of the system which includes the fuel tank and the canister that collects volatile fuel vapors from the tank's headspace.

BACKGROUND AND SUMMARY OF THE INVENTION

A typical evaporative emission control system in a modern automotive vehicle comprises a vapor collection canister that collects volatile fuel vapors generated in the fuel tank. During conditions conducive to purging, the canister is purged to the engine intake manifold by means of a canister purge system that comprises a canister purge solenoid valve that is operated by an engine management computer. The canister purge valve is opened in an amount determined by the computer to allow the intake manifold vacuum to draw vapors from the canister through the valve into the engine.

U.S. governmental regulations require that certain future automobiles that are powered by volatile fuel such as gasoline have their evaporative emission control systems equipped with on-board diagnostic capability for determining if a leak is present in a portion of the system which includes the fuel tank and the canister. One proposed response to that requirement is to connect a normally open solenoid valve in the canister vent, and to energize the solenoid when a diagnostic test is to be conducted. A certain vacuum is drawn in a portion of the system which includes the tank headspace and the canister, and with the canister and the tank headspace not being vented due to the closing of the canister vent, a certain loss of vacuum over a certain time will be deemed due to a leak. Loss of vacuum is detected by a transducer mounted on the fuel tank. Because of the nature of the construction of typical fuel tanks, a limit is imposed on the magnitude of vacuum that can be drawn. Too large a vacuum will result in deformation and render the measurement meaningless. In order to avoid this problem, a relatively costly vacuum transducer is required. Since typical automotive vehicles are powered by internal combustion engines which draw intake manifold vacuum, such vacuum may be used for performance of the diagnostic test, but typically this requires that the engine be running in order to perform the test.

The invention disclosed in commonly assigned application Ser. No. 07/770,009, filed Oct. 2, 1991, provides a solution to the leak detection problem which is significantly less costly. The key to that solution is a new and unique vacuum regulator/sensor which is disposed in the conduit between the canister purge solenoid and the canister. The vacuum regulator/sensor is like a vacuum regulator but with the inclusion of a switch that is used to provide a signal indicating the presence or the absence of a leak. A diagnostic test is performed by closing the tank vent and using the engine manifold vacuum to draw, via the canister purge solenoid valve and the vacuum regulator/sensor, a specified vacuum in the tank headspace and canister. Upon the requisite vacuum having been drawn, the vacuum regulator/sensor closes to trap the drawn vacuum. If unacceptable leakage is present, a certain amount of vacuum will be lost within a certain amount of time, and that occurrence causes the switch of the vacuum regulator/sensor to give a signal indicating that condition.

The present invention relates to a diagnostic system and method for evaluating the integrity of a portion of the canister purge system that includes the tank and canister by means of positive pressurization rather than negative pressurization (i.e., rather than by drawing vacuum). In certain canister purge systems, such a diagnostic system and method may afford certain advantages over the system and method described in the aforementioned commonly assigned patent application.

For example, it may be possible to omit the normally open solenoid operated vent valve that must be operated closed when the diagnostic test is to be performed. Certain types of leaks, for example cracked hoses and faulty gas caps, may be more susceptible to successful detection. Moreover, the evaporative emission control system may be diagnosed either with or without the automobile's engine running. One means to perform positive pressurization of the fuel tank's headspace and the canister is a devoted electric-operated air pump, which can be of quite simple construction, and therefore relatively inexpensive. If the vehicle already contains a source of suitably pressurized air, that could constitute another means, thereby eliminating the need for a separate devoted pump.

A further benefit of positive pressurization over negative pressurization is that the increased pressure suppresses the rate of fuel vapor generation in the tank, and such attenuation of fuel vapor generation during a diagnostic test reduces the likelihood that the test will give, under hot weather conditions which promote fuel vapor generation, a false signal that would erroneously confirm the integrity of the canister and tank whereas the same test during cold weather would indicate a leak.

Further specific details of the construction and arrangements of the inventive system, and of the method of operation thereof, along with additional features and benefits, will be presented in the ensuing description.

A drawing accompanies this disclosure and portrays a presently preferred embodiment of the invention according to the best mode presently contemplated for carrying out the invention.

DESCRIPTION OF THE PREFERRED EMBODIMENT

Figure 1:
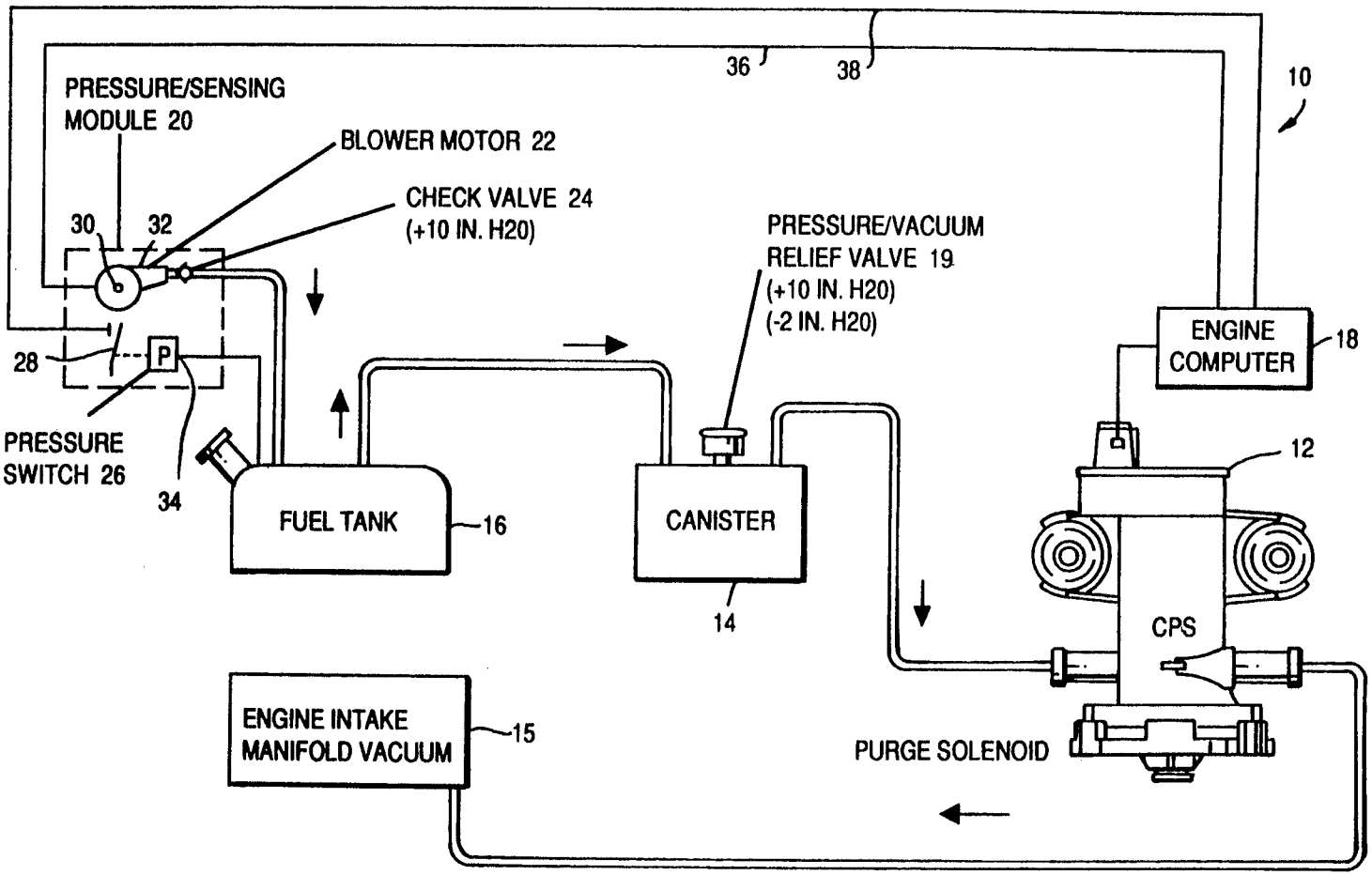
FIG. 1 is a schematic diagram of a representative canister purge system, including a diagnostic system embodying principles of the present invention.

FIG. 1 shows a representative canister purge system 10 embodying principles of the invention. System 10 comprises a canister purge solenoid valve 12 (CPS valve 12), and a carbon canister 14, associated with the intake manifold 15 of an automotive vehicle internal combustion engine and with a fuel tank 16 of the automotive vehicle which holds a supply of volatile liquid fuel for powering the engine. CPS valve 12 is under the control of an engine management computer 18 for the engine. A pressure/vacuum relief valve 19 is associated with canister 14. It is normally closed, but opens at a predetermined positive pressure, such as +10 inches of water for example, to prevent excessive positive pressure in the canister, and it also opens at a predetermined negative pressure, such as 31 2 inches of water for example, to prevent excessive negative pressure in the canister.

The canister purge system operates in conventional manner, and may be briefly described as follows. Under conditions conducive to purging, computer 18 causes the normally closed CPS valve 12 to open in a controlled manner. The result is that a certain amount of the engine manifold vacuum is delivered to canister 14 causing collected vapors to flow from the canister through the CPS valve to the engine manifold where they entrain with the induction fluid entering the engine's combustion chamber space to be ultimately combusted. To the extent that the pressure might seek to fall below −2 inches of water, relief valve 19 opens to allow the purge flow to continue without further pressure reduction in the tank/canister. Alternatively, relief valve 19 could be replaced by another device, such as a normally open solenoid operated vent valve which is operated closed for the diagnostic test.

In accordance with the invention, a pressure/sensing module 20 is associated with the system. It comprises an electric operated pump (blower motor) 22, a check valve 24, and a pressure sensing switch 26 having a set of contacts 28, which in the exemplary embodiment of FIG. 1 are normally open. Pump 22 has an air inlet 30 that is communicated to ambient air and an air outlet 32 that is communicated to an inlet of check valve 24. An outlet of the check valve is communicated to the headspace of tank 16. Pressure sensing switch 26 has a pressure sensing port 34 that is communicated to the tank headspace. When the pressure sensed by switch 26 at port 34 is below a set point, contacts 28 are open; when the pressure sensed by switch 26 at port 34 is above the set point, contacts 28 are closed. However, the switch is intentionally designed and calibrated to have a certain hysteresis at its set point. For example, the switch may close contacts 28 at a certain high positive pressure, say +5 inches of water, which is below the positive pressure at which relief valve 19 opens, but re-open them only after the pressure has fallen a predetermined amount below the pressure that closed them, for example re-opening the contacts at +2 inches of water.

Module 20 is also electrically connected with computer 18. One electric circuit connection 36 coupling module 20 with computer 18 provides for the computer to control the operation of pump 22; another connection 38 provides for switch 26 to signal the computer.

The system functions in the following manner to perform a diagnostic test on the integrity against unacceptable leakage of that portion of the CPS system that is upstream of CPS valve 12. First, computer 18 commands CPS valve 12 to be closed and detects whether contacts 28 are open or closed. If contacts 28 are closed, a pre-existing positive pressure condition in the tank/canister exists that will preclude the performance of the diagnostic test at that time. Accordingly, the test is deferred to a later time, and in this regard it should be mentioned that the timing at which tests are attempted is determined by various other inputs to or programs of computer 18 that need not be mentioned here. On the other hand, if computer 18 detects contacts 28 to be open, then the pre-existing pressure in the tank/canister is deemed suitable for the test to proceed.

That being the case, computer 18 commands pump 22 to operate and thus increasingly positively pressurize the tank/canister. As the pump operates, the tank/canister positive pressure should build. However, the presence of a grossly unacceptable leak in the tank/canister could prevent the pressure from building to a predetermined positive pressure within a predetermined time. Thus, if contacts 28 remain open for at least a certain amount of time after the computer has issued its command to operate pump 22, a fault is indicated. Such fault may be attributed to any one or more of: a gross leak in the tank/canister, a faulty connection between module 20 and computer 18, a faulty pump 22, a faulty check valve 24, or a faulty pressure switch 26. In such an event the test is terminated and a fault indication given.

However, if the pressure in the tank/canister builds within a predetermined time to the setting that will cause pressure switch 26 to close contacts 28, then the test proceeds. Once closure of switch contacts 28 is detected by computer 18, the computer immediately shuts off pump 22. Check valve 24 functions to prevent loss of pressure back through the pump. This traps the pressure in the tank/canister, and the trapped pressure is initially essentially equal to that at which contacts 28 closed, i.e. +5 inches water in the example. If a leak is present in the tank/canister, positive pressure will begin to decrease. The rate at which the positive pressure decreases is a function of the severity of the leak. An unacceptable leak will cause the positive pressure to drop to at least a certain preselected level within a given time; the absence of a leak or the presence of a leak that is so small as to not be deemed unacceptable will not cause the pressure to drop below that preselected level within that given time.

Associated with computer 18 is a timer which begins counting time upon detection of closure of contacts 28. If, after a certain preselected amount of time has been counted, contacts 28 remain closed, the integrity of the test-ensealed tank/canister volume is deemed to have been confirmed, and computer 18 may so indicate in any appropriate manner such by an internal flag or an external signal.

On the other hand, the re-opening of the contacts during the testing time is deemed to indicate an unacceptable leak, and such occurrence will be flagged by the computer as a fault signal or called to the attention of the vehicle operator by any suitable means such as a warning lamp on the instrument panel.

It may be mentioned at this point that the invention can enable a test to be performed at relatively small positive pressure levels in the canister and fuel tank so that the pressure will not cause deformation of properly designed canisters and tanks. At the completion of a test the canister purge valve is once again operated by computer 18 in the usual way for conducting canister purging.

If a diagnostic test is conducted above a certain temperature, it is possible that fuel vapors may be generated in the tank at a rate that is sufficiently fast that the increase in vapor pressure will mask at least to some extent the existence of a leak. This tendency is somewhat better countered by the present invention in comparison to that of the referenced application Ser. No. 07/770,009 because the increased positive pressurization tends to attenuate the vapor generation rate. Hence, the present invention may allow testing to proceed under higher ambient temperatures than in the case of the prior system. However, since ambient temperature or engine temperature may still influence the test to some extent, one may choose to employ a temperature sensor mounted on the fuel tank to provide a fuel temperature measurement to the computer and/or the engine coolant sensor to provide a temperature measurement to the computer. If the temperature is not below a predetermined temperature above which the generation of vapor could affect the validity of the test, the test would be deemed invalid. Valid testing would therefore occur only below the predetermined temperature.

Principles of the invention are also applicable to the use of an electrically operated pump to draw negative pressure, instead of positive pressure. In such a case, the directions of blower motor 30 and check valve 32 would be reversed. Pressure switch 26 would operate in analogous manner to that described above, while being arranged to look for a predetermined loss of vacuum within a predetermined time. Likewise, an analog detecting and signaling device could be used in place of the pressure switch.

Having disclosed generic principles of the invention, this application is intended to provide legal protection for all embodiments falling within the scope of the following claims.

What is claimed is:

1. A canister purge system comprising a collection canister for collecting volatile fuel vapors from a fuel tank, and means for selectively purging collected fuel vapors from said, canister to an internal combustion engine's intake manifold for entrainment with a combustible mixture that passes from the manifold into combustion chamber space of the engine for combustion therein, said means including a purge flow path between said canister and intake manifold, characterized by an associated diagnostic system that detects unacceptable leakage from a portion of the canister purge system, which portion includes said canister and tank, and that comprises means for positively pressurizing said portion to a predetermined positive pressure, detecting means for detecting a certain decrease in the positive pressure, in said portion from said predetermined positive pressure indicative of unacceptable leakage from said portion, and signaling means for giving a signal indicative of such decrease.

2. A canister purge system as set forth in claim 1 characterized further in that said means for positively pressurizing said portion to a predetermined positive pressure comprises an electrically operated pump.

3. A canister purge system as set forth in claim characterized further in that said detecting means and said signaling means collectively comprise a pressure switch having a set of electrical contacts.

4. In an automotive vehicle comprising an internal combustion engine for powering the vehicle, an engine management computer for controlling certain functions associated with the operation of said engine, said comprising an intake manifold within which vacuum is created during operation of the engine, said vehicle comprising a fuel tank for containing a supply of a volatile liquid fuel for the engine, and an evaporative emission control system comprising a collection canister for collecting volatile fuel vapors from the fuel tank, and means for selectively purging collected fuel vapors from said canister to an internal combustion engine's intake manifold for entrainment with a combustible mixture that passes from the intake manifold into combustion chamber space of the engine for combustion therein, said means including a purge flow path comprising a canister purge solenoid valve that is between said canister and intake manifold and that is under the control of said engine management computer, the improvement characterized by an associated diagnostic system that detects unacceptable leakage from a portion of the evaporative emission control system which portion includes said canister and tank and that comprises an electrically operated pump for positively pressurizing said portion to a predetermined positive pressure, a check valve between said portion and said pump for preventing loss of positive pressure from said portion back through said pump, a pressure switch for detecting the pressure in said portion, and means operatively relating said canister purge solenoid valve, said pressure switch, said pump, and said computer such that a diagnostic test to confirm the integrity of said portion against unacceptable leakage comprises said computer causing said canister purge solenoid valve to be operated closed and said pump to build positive pressure in said portion, and when said pressure switch senses the pressure in said portion having been built to a predetermined positive pressure, said computer causing said pump to cease building positive pressure in said portion so that the positive pressure in said portion as trapped therein by said check valve at the time said pump ceases building positive pressure is essentially equal to said predetermined positive pressure, and if pressure in said portion decreases from said predetermined positive pressure by a certain amount within a certain amount of time indicative of unacceptable leakage from said portion, said pressure switch giving to said computer a signal to indicate such unacceptable leakage.

5. The improvement set forth in claim 4 in which said pressure switch comprises a set of switch contacts that operate from one state to another state upon said pressure in said portion having built to said predetermined positive pressure and that operate back to said one state when pressure in said portion decreases from said predetermined positive pressure by a certain amount within a certain amount of time indicative of unacceptable leakage from said portion, said signal to said computer to indicate such unacceptable leakage being the operation of said set of switch contacts from said another state back to said one state.

6. The improvement set forth in claim 5 in which the operation of said set of switch contacts from said one state to said another state causes said computer to cause the operation of said pump to terminate.

7. In an automotive vehicle comprising an internal combustion engine for powering the vehicle, an engine management computer for controlling certain functions associated with the operation of said engine, said engine comprising an intake manifold within which vacuum is created during operation of the engine, said vehicle comprising a fuel tank for containing a supply of a volatile liquid fuel for the engine, and an evaporative emission control system comprising a collection canister for collecting volatile fuel vapors from the fuel tank, and means for selectively purging collected fuel vapors from said canister to an internal combustion engine's intake manifold for entrainment with a combustible mixture that passes from the intake manifold into combustion chamber space of the engine for combustion therein, said means including a purge flow path comprising a canister purge solenoid valve that is between said canister and intake manifold and that is under the control of said engine management computer, the improvement characterized by an associated diagnostic system that detects unacceptable leakage from a portion of the evaporative emission control system which portion includes said canister and tank and that comprises an electrically operated pump for positively pressurizing said portion to a predetermined positive pressure, a check valve between said portion and said pump for preventing loss of positive pressure from said portion back through said pump, a pressure switch for detecting the pressure in said portion, and means operatively relating said canister purge solenoid valve, said pressure switch, said pump, and said computer such that a diagnostic test to confirm the integrity of said portion against unacceptable leakage comprises said computer causing said canister purge solenoid valve to be operated closed and said pump to build positive pressure in said portion, and if said pressure switch fails to sense the pressure in said portion having been built to a predetermined positive pressure within a predetermined time, said computer indicating unacceptable leakage in said portion.

8. A canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and intake manifold, characterized by an associated diagnostic system that detects unacceptable leakage from a portion of the canister purge system, which portion includes said canister and tank, and that comprises an electrically operated pump for creating a certain initial pressure in said portion at the beginning of a test and then ensealing said portion, detecting means for detecting change in the pressure in said portion from said initial pressure indicative of unacceptable leakage from said portion, and signaling means for giving a signal indicative of the detection of such change.

9. A canister purge system as set forth in claim 8 characterized further in that said initial pressure is a positive pressure.

10. A canister purge system as set forth in claim 8 characterized further in that said detecting means and said signaling means collectively comprise a pressure switch having a set of switch contacts.

11. A canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and intake manifold, characterized by an associated diagnostic system that confirms the absence of unacceptable leakage from a portion of the canister purge system, which portion includes said canister and tank, and that comprises means for positively pressurizing said portion to a predetermined positive pressure, detecting means for detecting the absence of a certain decrease in the positive pressure in said portion from said predetermined positive pressure, which decrease is indicative of unacceptable leakage from said portion, and signaling means for giving a signal indicative of the absence of such decrease.

12. A canister purge system as set forth in claim 11 characterized further in that said means for positively pressurizing said portion to a predetermined positive pressure comprises an electrically operated pump.

13. A canister purge system as set forth in claim 11 characterized further in that said detecting means and said signaling means collectively comprise a pressure switch having a set of electrical contacts.

14. A canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and intake manifold, characterized by an associated diagnostic system that confirms the absence of unacceptable leakage from a portion of the canister purge system, which portion includes said canister and tank, and that comprises an electrically operated pump for creating a certain initial pressure in said portion at the beginning of a test and then ensealing said portion, detecting means for detecting the absence of change in the pressure in said portion from said initial pressure, which change is indicative of unacceptable leakage from said portion, and signaling means for giving a signal indicative of the absence of such change.

15. A canister purge system as set forth in claim 14 characterized further in that said initial pressure is a positive pressure.

16. A canister purge system as set forth in claim 14 characterized further in that said detecting means and said signaling means collectively comprise a pressure switch having a set of switch contacts.

17. In a canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and intake manifold, a method for diagnosing unacceptable leakage from a portion of the canister purge system, which portion includes said canister and tank, said method comprising positively pressurizing said portion to a predetermined positive pressure, detecting a certain decrease in the positive pressure in said portion from said predetermined positive pressure indicative of unacceptable leakage from said portion, and giving a signal indicative of such decrease.

18. In a canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and intake manifold, a method for diagnosing unacceptable leakage from a portion of the canister purge system, which portion includes said canister and tank, said method comprising creating by means of an electrically operated pump a certain initial pressure in said portion at the beginning of a test and then ensealing said portion, detecting change in the pressure in said portion from said initial pressure indicative of unacceptable leakage from said portion, and giving a signal indicative of the detection of such change.

19. In a canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and intake manifold, characterized by a method for confirming the absence of unacceptable leakage from a portion of the canister purge system, which portion includes said canister and tank, said method comprising positively pressurizing said portion to a predetermined positive pressure, detecting the absence of a certain decrease in the positive pressure in said portion from said predetermined positive pressure, which certain decrease is indicative of unacceptable leakage from said portion, and giving a signal indicative of the absence of such decrease.

20. In a canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and intake manifold, characterized by a method that confirms the absence of unacceptable leakage from a portion of the canister purge system, which portion includes said canister and tank, and that comprises creating by means of an electrically operated pump a certain initial pressure in said portion at the beginning of a test and then ensealing said portion, detecting the absence of change in the pressure in said portion from said initial pressure, which certain change is indicative of unacceptable leakage from said portion, and giving a signal indicative of the absence of such change.

* * * * *